US006805777B1

(12) United States Patent
D'Astolfo, Jr.

(10) Patent No.: US 6,805,777 B1
(45) Date of Patent: Oct. 19, 2004

(54) MECHANICAL ATTACHMENT OF ELECTRICAL CURRENT CONDUCTOR TO INERT ANODES

(75) Inventor: Leroy E. D'Astolfo, Jr., Lower Burrell, PA (US)

(73) Assignee: Alcoa Inc., Pittsburgh, PA (US)

( * ) Notice: Subject to any disclaimer, the term of this patent is extended or adjusted under 35 U.S.C. 154(b) by 23 days.

(21) Appl. No.: 10/405,510

(22) Filed: Apr. 2, 2003

(51) Int. Cl.[7] ..... C25B 11/00

(52) U.S. Cl. ..... 204/280; 204/286.1; 204/291; 204/292; 204/293

(58) Field of Search ..... 204/280, 286.1, 204/291, 292, 293; 205/380, 384, 386, 388

(56) References Cited

U.S. PATENT DOCUMENTS 4,374,761 A 2/1983 Ray
4,495,049 A * 1/1985 Secrist et al. ..... 204/292
4,609,249 A * 9/1986 Hornack et al. ..... 204/288.2
4,626,333 A * 12/1986 Secrist et al. ..... 204/288.2
5,279,715 A 1/1994 La Camera et al.
6,126,799 A 10/2000 Ray et al.
6,217,739 B1 4/2001 Ray et al.
6,372,119 B1 4/2002 Ray et al.
6,416,649 B1 7/2002 Ray et al.
6,423,195 B1 7/2002 Ray et al.
6,423,204 B1 7/2002 Ray et al.
2001/0037946 A1 11/2001 D'Astolfo, Jr. et al.

* cited by examiner

*Primary Examiner*—Bruce F. Bell
(74) *Attorney, Agent, or Firm*—Daniel P. Cillo; Tracey D. Beiriger

(57) ABSTRACT

An inert anode (10) for use in an electrolysis process to make metals such as aluminum, contains a hollow interior with an open top portion (16), an interior closed bottom (18) and interior walls (19) where the top interior side walls (16) have at least one interior groove (20) which helps relieve stress on the anode material and helps provide locking and support of the anode.

14 Claims, 2 Drawing Sheets

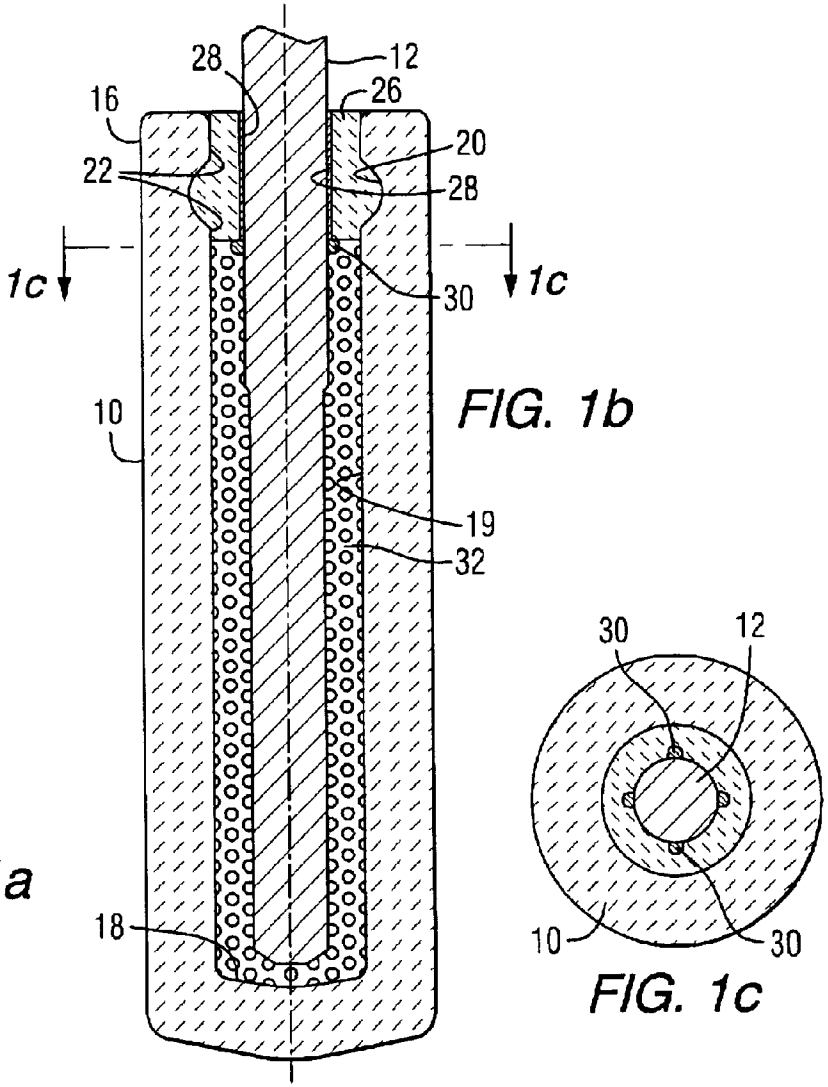
FIG. 1b
FIG. 1c
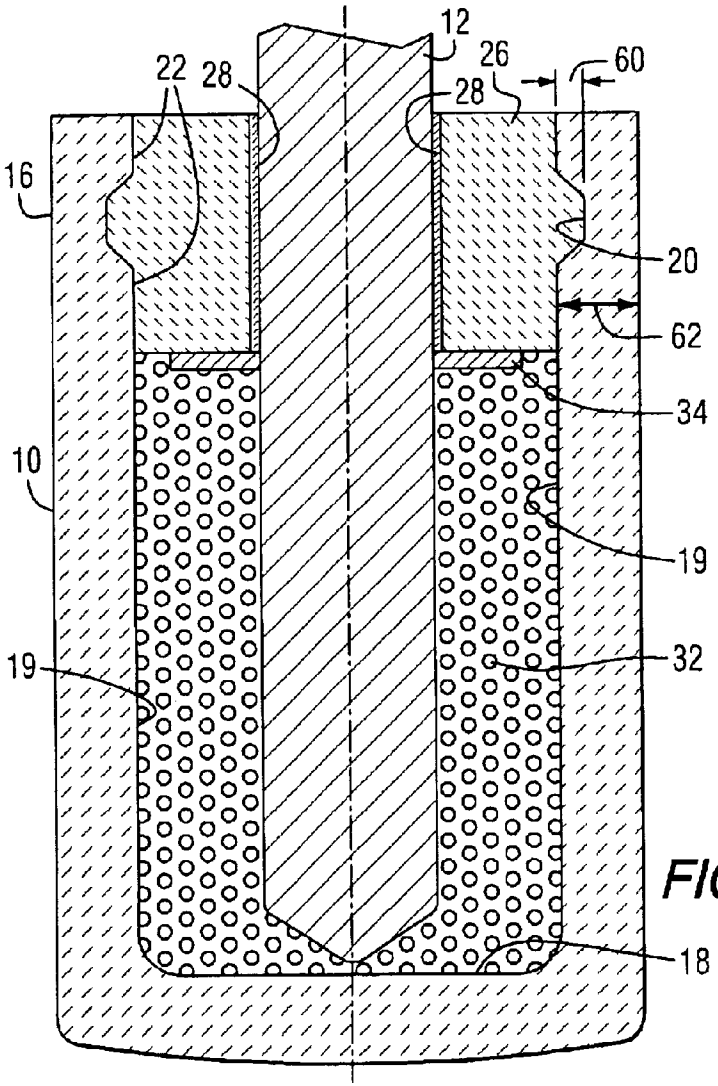
FIG. 1a

MECHANICAL ATTACHMENT OF ELECTRICAL CURRENT CONDUCTOR TO INERT ANODES

FIELD OF THE INVENTION

This invention relates to a hollow inert anode having top internal grooves to aid in mechanical attachment to an internal current collector, for use in metal electrolysis processes.

BACKGROUND OF THE INVENTION

A number of metals including aluminum, lead, magnesium, zinc, zirconium, titanium, and silicon can be produced by electrolysis processes. Each of these electrolytic processes preferably employs an electrode having a hollow interior.

One example of an electrolysis process for metal production is the well-known Hall-Heroult process producing aluminum in which alumina dissolved in a molten fluoride bath is electrolyzed at temperatures of about 960° C.–1000° C. As generally practiced today, the process relies upon carbon as an anode to reduce aluminum to molten aluminum. Despite the common usage of carbon as an electrode material in practicing the process, there are a number of serious disadvantages to its use, and so, attempts are being made to replace them with inert anode electrodes made of for example a ceramic or metal-ceramic "cermet" material.

Ceramic and cermet electrodes are inert non-consumable and dimensionally stable under cell operating conditions. Replacement of carbon anodes with inert anodes allows a highly productive cell design to be utilized, thereby reducing costs. Significant environmental benefits are achievable because inert electrodes produce essentially no $CO_2$ or fluorocarbon or hydrocarbon emissions. Some examples of inert anode compositions are found in U.S. Pat. Nos. 4,374,761; 5,279,715; and 6,126,799; 6,217,739; 6,372,119; 6,416,649; 6,423,204 and 6,423,195, all assigned to Alcoa Inc.

Although ceramic and cermet electrodes are capable of producing aluminum having an acceptably low impurity content, they are relatively expensive. Also, to save costs most have a hollow interior into which a conductor rod is sintered/sealed in place. These inert anodes are molded, extruded, or preferably isostatically pressed usually at about 30,000 psi around a smooth round mandrel, which after release of pressure and mandrel removed, provides an unsintered, hollow green anode. This anode must be subsequently fired to sinter it.

In the development of non-metallic, non-consumable electrodes for the production of aluminum and other metals, it is necessary to provide a means of attachment between the conductor, usually metallic, and the non-metallic electrode. This poses technical challenges due to the inherent mismatch in mechanical properties, such as coefficient of thermal expansion, strength and ductility between the two materials. Various solutions have been proposed, including interference fits, locking taper fits, twist and lock arrangements, embedded bolts, and diffusion welding. All of these solutions have one or more severe shortcomings, such as being extremely labor intensive requiring precision machining, relying on precision fits, which exert considerable stress on the brittle electrode material, or requiring long processing time or additional furnace heats.

One example of the inert anode useful in the production of aluminum is shown in FIG. 3 of U.S. Patent Application Publication 2001/0037946 A1 (D'Astolfo Jr. et al.). These anodes operate in a very hot and corrosive environment and must be heated before insertion into a molten cryolite bath.

In one way to make inert anodes, a solid cylindrical mandrel and accompanying flexible mold were used to consolidate ceramic/cermet material into a hollow anode shape through isostatic pressing. After pressing, the mandrel was removed from the anode shape and the shape removed from the mold.

The unfired green part anode shape was then placed upside down (hollow side down) on a firing tray for sintering. After sintering in a kiln, the assembly of an anode was completed.

What is needed is an improved inert anode design that will eliminate the need for inert anode/metal conductor precision fits and relieve stress on the inert anode electrode material. It is a main object of this invention to provide such inert anodes.

SUMMARY OF THE INVENTION

The above needs are met and object attained by providing an inert electrode, the electrode having a hollow interior with a top open portion, an interior closed bottom, and side walls, where the interior sidewalls of the top portion have at least one interior groove. The invention also resides in an electrode assembly comprising: (1) an inert electrode having a hollow interior with a top open portion, an interior closed bottom, and side walls, where the interior side walls of the top portion have at least one interior groove; (2) a metal pin conductor having bottom and side surfaces, disposed within the electrode interior but not contacting the electrode interior walls creating an annular gap; and (3) a seal material surrounding the metal pin conductor at the top portion of the electrode, where the seal material fills substantially all of the top annular volume between the at least one interior groove and the top of the conductor, and where a conductive filler material fills at least part of the bottom annular gap between the electrode bottom and the conductor bottom. Preferably, a compliant expansion material is disposed between the conductor and the seal material to protect the seal material from differential thermal expansion. The inert anode material can comprise ceramic, cermet or a metal containing material, such as, for example those described in the above Alcoa patents.

This invention accomplishes a mechanical attachment that is completely internal to the electrode. A support platform can be provided around the conductor pin below seal material, which serves as the primary means of support. Inside the top of the electrode, the circular or other type groove(s) provide, a locking mechanism. The seal material can be a castable ceramic or refractory material to lock the electrode in position relative to the conductor. Also, insulating materials may be added between the castable and conductor or support ring. The advantages of this invention include: no precision machining is required, no precision tolerances are required, there is little or no stress on the electrode material, no additional furnace heats or long process steps are required, and the materials used are inexpensive.

BRIEF DESCRIPTION OF THE DRAWINGS

A full understanding of the invention can be gained from the above and following description when read in conjunction with the accompanying drawings in which:

FIG. 1, which best describes the invention, is a cross-sectional view showing, in FIG. 1*a*, a large diameter inert anode and electrode assembly with one internal anode groove and platform support FIG. 1*b* small diameter inert anode with one internal anode groove, and a simpler support platform comprising several protrusions on the metallic conductor, and FIG. 1*c* shows a cross-sectional view of the inert anode of 1*b*, and shows in more detail the protrusions on the conductor.

DETAILED DESCRIPTION OF PREFERRED EMBODIMENTS

Figure 2A:
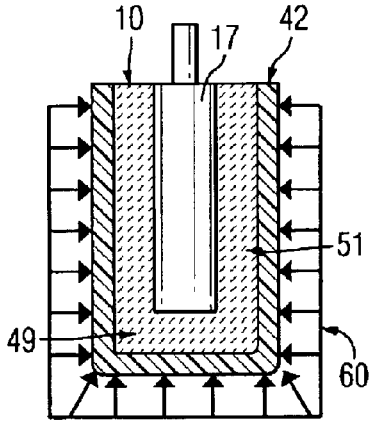
FIG. 2, showing steps 2*a* o 2*f*, is a schematic diagram of one embodiment of a process for forming green inert anodes with interior anode grooves.
Figure 2B:
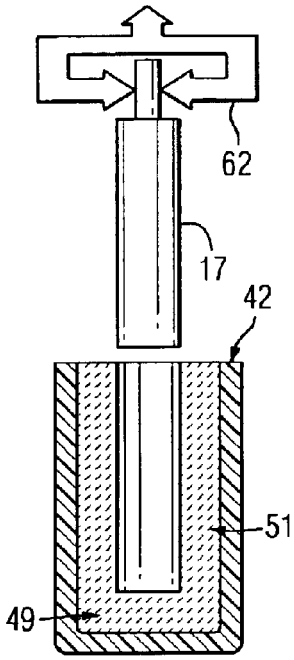

Referring now to FIG. 1, two embodiments of hollow, filled inert anode electrodes and their associated assemblies are shown in FIG. 1*a* and FIG. 1*b*. The inert anode electrode 10 in both FIGS. is made of sintered compressed powder of inert anode material. This powder is at least one of inert ceramic, cermet or metal containing material. A round solid metal conductor 12 is shown disposed within the hollow electrode shape 10. As used herein, the term "inert anode" refers to a substantially non-consumable, non-carbon anode having satisfactory resistance to corrosion and dimensional stability during the metal production process.

The hollow type, inert anode shape 10 would have a top 16, a bottom interior wall 18 and side interior walls 19. The inert anode electrode shape 10 is shown after initial forming and sintering at from about 1300° C. to 1600° C. to provide the hollow sintered structure shown into which the conductor rod 12 can be inserted and attached by a variety of means. The attachment in this invention is by means of at least one interior groove/depression 20 into the interior sidewall of the top portion 16 of the anode shape. In FIGS. 1*a* and 1*b* there is one interior groove 20 disposed between two flat interior electrode walls 22. There is an annular gap between the interior electrode walls and the exterior conductor as shown in FIGS. 1*a* and 1*b*. A seal material 26 surrounds the conductor 12 at the top portion 16 of the electrode filling substantially all of the top annular volume between grooves 20 and the top of the conductor. An expansion joint 28, made of for example of a ceramic felt, and the like or other thin material can be disposed between the seal material 26 and the conductor 12 as shown in FIGS. 1*a* and 1*b*. The seal material 26 can be a castable ceramic, such as aluminosilicates, calcium aluminates, or other materials.

A shown in FIG. 1*a*, conducting filler 32 can be used in the bottom annulus as will as an Inconel or other support ring 34, shown in FIG. 1*a*, near the top part of the annulus. The expansion joint 28 at the top of the electrode is a compliant expansion material and selected to protect the seal material 26 upon heat up and operation of the electrode, for example at about 960° C., in an aluminum electrolysis cell. In FIG. 1*b* conducting filler 32 fills most of the annulus simplifying construction. FIG. 1*b*and 1*c*show protrusion 30 on the top surface of conductor 12 below the grooves 20. These protrusions can simply be, for example, weld build-ups on the conductor surface, usually about 3 to 6 weld build-ups.

Figure 2C:
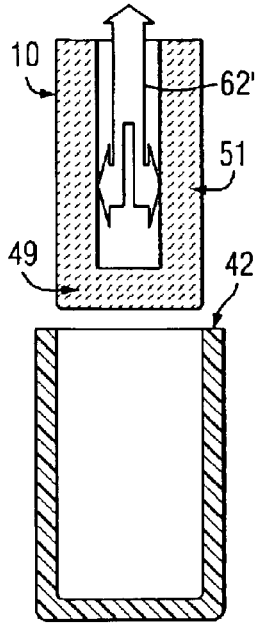
Figure 2D:
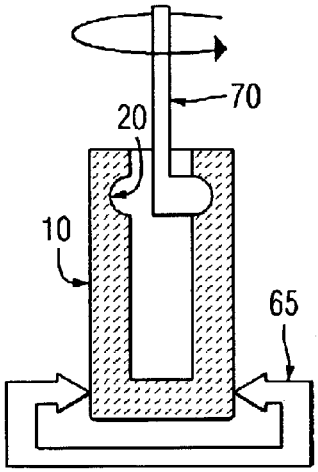
Figure 2E:
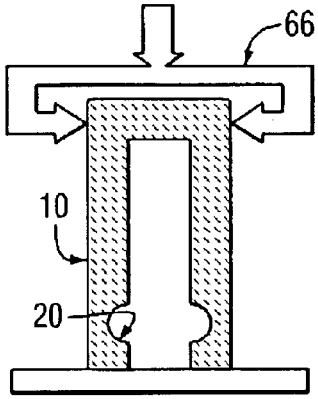
Figure 2F:
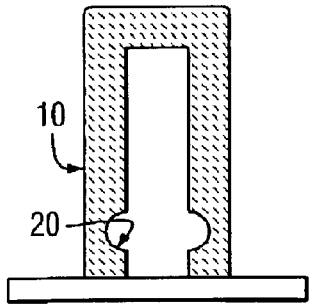

FIGS. 2*a* to 2*f*, which are steps as well as figures, schematically illustrate one of many possible processes of making the inert anode electrode form 10. As shown in FIG. 2*a*, a smooth surfaced mandrel 17 is placed inside a flexible mold 42, such as high strength polyurethane, on top of ceramic/cermet powder 49. Additional powder 51, is placed around the mandrel in the annular space between the mandrel and the mold. Pressure 60 is then exerted on the outside of the flexible mold, such as by isostatic pressing at from about 20,000 psi to 40,000 psi (137,800 kPa to 206,700 kPa) to form a consolidated compressed ceramic/cermet part. When the pressing cycle is complete and pressure relieved, in FIG. 2*b*, an auxiliary gripping device 62 captures the top of the mandrel and removes it vertically from the bore of the pressed part 10. In FIG. 2*c*, one means of anode extraction is shown, for example, a different core gripping device 62' is inserted inside the bore of the part and radially expanded to engage the part bore surface. The device and captured part are then both raised vertically, thereby extracting the compressed ceramic/cermnet part from the mold 42. After mold extraction, the part is released from the bore gripping device and transferred as shown in FIG. 2*d* where the outside of the ceramic/cermet part is constrained by another gripping device 65, while rotating cutter 70, with associated rotation arrow, machines one or more square/annular or other type grooves 20 into the upper, top portion of the part bore. In FIG. 2*e*, after machining of the groove 20 has been completed and the part released from device 65, the compressed/machined ceramic/cermet part is regripped by new device 66 around its outside diameter. The part is next inverted, open side down, and placed, all shown in FIG. 2*f*, on a tray for sintering.

The groove(s) shown in FIGS. 1*a*, 1*b*, and 2*d*–2*f* can be a single groove, plural grooves that need not be matching on each side, or continuous grooves, and can have, as shown in FIG. 1*a*, a depth 60 of from about 10% to 50% of the wall thickness 62 of the anode, preferably from about 10% to 40%. Below 10% pressure weight and the bearing surfaces of the grooves become too small, thereby concentrating too much force on a small area of the anode material. Above 50% and the groove compromises the strength and integrity of the anode. The groove can have a round bottom, flat bottom or any other desirable geometry. The bottom and sides of the groove act as a weight bearing surface and in combination with the castable material 26 inside the groove help support the inert anode.

It should be understood that the present invention may be embodied in other forms without departing from the spirit or essential attributes thereof, and accordingly, reference should be made to both the appended claims and to the foregoing specification as indicating the scope of the invention.

What is claimed is:

1. An inert electrode, the electrode having a hollow interior with a top open portion, an interior closed bottom, and side walls, where the interior side walls of the top portion have at least one interior groove.

2. The inert electrode of claim 1, wherein the electrode is a ceramic material.

3. The inert electrode of claim 1, wherein the electrode is a sintered electrode.

4. The inert electrode of claim 1, wherein the electrode contains one interior groove and the groove is disposed between two flat interior electrode walls.

5. The inert electrode of claim 1, wherein the electrode contains a plurality of interior grooves.

6. The inert electrode of claim 1, wherein the at least one groove has a depth of from about 10% to 50% of the wall thickness of the anode.

7. The inert electrode of claim 1, wherein the at least one groove has a depth of from about 10% to 40% of the wall thickness of the anode.

8. An electrode assembly comprising:

(1) an inert electrode having a hollow interior with a top open portion, an interior closed bottom, and side walls, where the interior side walls of the top portion have at least one interior groove;

(2) a metal pin conductor having bottom and side surfaces, disposed within the electrode interior but not contacting the electrode interior walls creating an annular gap; and (3) a seal material surrounding the metal pin conductor at the top portion of the electrode where the seal material fills substantially all of the top annular volume between the at least one interior groove and the top of the conductor, and where a conductive filler material fills at least part of the bottom annular gap between the electrode bottom and the conductor bottom.

9. The electrode assembly of claim 8, wherein the at least one groove has a depth of from about 10% to 50% of the wall thickness of the anode.

10. The electrode assembly of claim 8, wherein the at least one groove has a depth of from about 10% to 40% of the wall thickness of the anode.

11. The electrode assembly of claim 8, wherein the electrode is a ceramic material.

12. The electrode assembly of claim 8, wherein the electrode is a sintered electrode.

13. The electrode assembly of claim 8, wherein the electrode contains one interior groove and the groove is disposed between two flat interior electrode walls.

14. The electrode assembly of claim 8, wherein the electrode contains a plurality of interior grooves.

* * * * *

UNITED STATES PATENT AND TRADEMARK OFFICE
Certificate

Patent No. 6,805,777 B1 Patented: October 19, 2004

On petition requesting issuance of a certificate for correction of inventorship pursuant to 35 U.S.C. 256, it has been found that the above identified patent, through error and without any deceptive intent, improperly sets forth the inventorship.

Accordingly, it is hereby certified that the correct inventorship of this patent is: Leroy E. D'Astolfo, Jr., Lower Burell, PA (US); and James T. Burg, Verona, PA (US).

Signed and Sealed this Nineteenth Day of April 2011.

ALEXA D. NECKEL
*Supervisory Patent Examiner*
Art Unit 1723
Technology Center 1700